United States Patent [19]

Battles

[11] Patent Number: 4,838,001

[45] Date of Patent: Jun. 13, 1989

[54] WINDOW GRID LATCH

[75] Inventor: Laurence Battles, Roosevelt, Minn.

[73] Assignee: Marvin Lumber and Cedar Company, Warroad, Minn.

[21] Appl. No.: 151,523

[22] Filed: Feb. 2, 1988

[51] Int. Cl.[4] ..... E06B 3/68

[52] U.S. Cl. ..... 52/456; 52/106; 52/311; 52/314; 49/50; 49/57; 292/67

[58] Field of Search ..... 52/106, 311, 314, 456, 52/664–668; 49/56, 57, 50; 292/63, 67, 171, 175, 332

[56] References Cited

U.S. PATENT DOCUMENTS

| | | | |
|---|---|---|---|
| 528,769 | 11/1894 | Dickson | 292/175 |
| 966,780 | 8/1910 | Thomas | 292/175 |
| 1,240,086 | 9/1917 | Parker | 292/332 |
| 2,477,524 | 7/1949 | Osward et al. | 292/175 |
| 2,523,559 | 9/1950 | Couture | 292/175 X |
| 2,681,481 | 6/1954 | Mason . | |
| 3,099,865 | 8/1963 | Burnett . | |
| 3,108,336 | 10/1963 | Tate . | |
| 3,221,462 | 12/1965 | Pomeroy . | |
| 3,307,316 | 3/1967 | Gray . | |
| 3,340,661 | 9/1967 | Krieger . | |
| 3,381,431 | 6/1968 | Jacobson . | |
| 3,474,587 | 10/1969 | Martin . | |
| 3,918,202 | 11/1975 | Smith | 52/456 X |
| 4,000,590 | 1/1977 | Kordewick . | |
| 4,135,747 | 1/1979 | Melilli | 292/175 |

*Primary Examiner*—David A. Scherbel
*Assistant Examiner*—Richard E. Chilcot, Jr.
*Attorney, Agent, or Firm*—James R. Haller

[57] ABSTRACT

A window grid attachment device for removably attaching a decorative window grid to a window sash, adjacent a window pane. The device comprises a tubular barrel, a forward opening carried by one end of the barrel, a pin means carried by the barrel which is movable axially between an extended position, in which the tip of the pin protrudes forwardly of the barrel opening, and a retracted position, in which the pin is sheltered within the barrel. A finger operable handle is included for moving the device between extended and retracted positions. A latch means is carried by the barrel for releasibly latching the pin means to the barrel in the retracted position. The device is carried in an axial bore of a window grid member and allowed to contact a window sash in its extended position thereby removably attaching a window grid adjacent a window pane.

7 Claims, 3 Drawing Sheets

WINDOW GRID LATCH

FIELD OF THE INVENTION

The invention relates to window grid construction, and particularly to fasteners for removably attaching window grid units to the sashes of windows.

BACKGROUND OF THE INVENTION

Conventional windows used extensively in the construction industry generally comprise a single pane of glass carried peripherally by a window sash. It is particularly desirable at times to make the window pane appear to be comprised of a plurality of window panes carried adjacent one another. In order to accomplish this effect, lattice window grids often are installed adjacent window panes with the ends of the lattice strips being attached to the sash.

Several fastening methods have been employed in the past to attach lattice window grids to window sashes. One of the methods, shown in U.S. Pat. No. 3,099,865, uses a magnet part and a magnetic attractable part, one of the parts being fixed to an end of a lattice strip, and the other part being carried by the sash to magnetically hold the grid in place. A hinged mullion frame is shown in U.S. Pat. 2,681,481 and rotates about a horizontal axis into contact with a window and is attached at its base to a window sash by means of a spring loaded latch. U.S. Pat. No. 3,340,661 discloses a decorative grill mounted to a window sash by resilient members inserted coaxially into the free ends of the grill to contact the sash.

It would be desirable to provide a simple device enabling a user to easily install and remove decorative window grids from a window.

DISCLOSURE OF THE INVENTION

The invention relates to a window grid latch for removably attaching a decorative window grid to a window sash. The device includes an elongated housing adapted to be carried by the end of a window grid, and pin means, the latter including an elongated pin movable longitudinally of its length between extended and retracted positions with respect to the housing and movable transversely of its length. Spring means are provided within the housing to bias the pin into its extended position. The pin means and housing are provided with cooperating latching elements for releasably latching the pin in its retracted position in response to transverse movement of the pin with respect to the housing.

In a preferred embodiment, the latching element of the pin means comprises the forward end of the pin, and the housing has a forward wall having an inner surface facing the foward pin end and defining a latching element which, when contacted by the forward end of the pin, retains the pin in its retracted position.

In its preferred embodiment, the housing is generally barrel shaped and has forward and rearward end walls. The forward wall is provided with a port through which the pin of the pin means may be extended and withdrawn. The pin means includes a rearwardly directed spring seat which contacts a spring means positioned between the rear wall of the housing and the pin means to urge the spring seat and hence the pin forwardly, thus biasing the pin toward its extended position. Slots are provided through walls of the housing, and manually operable handles extend from the pin means within the housing outwardly through the slots for external operation. When the pin is in its retracted position within the housing, the pin can be moved transversely of its length so that its forward end comes into forward contact with the inner surface of the front wall of the housing, thereby holding the pin in its retracted position. When the pin is to be extended, the handle is manipulated to bring the pin into alignment with the orifice in the front housing wall, whereupon the pin is spring biased outwardly into its extended position.

In another embodiment, the invention relates to a window grid that is attachable to the sash of a window, the grid comprising a plurality of elongated grid elements having ends adapted to closely confront the sash of a window, and at least some of the grid elements having end portions with walls defining longitudinally extending openings sized to snugly receive and retain the housing of a grid latch of the invention. The walls may have longitudinally extending openings therein through which may extend the handles of the pin means.

DETAILED DESCRIPTION OF THE PREFERRED EMBODIMENTS

Figure 1:
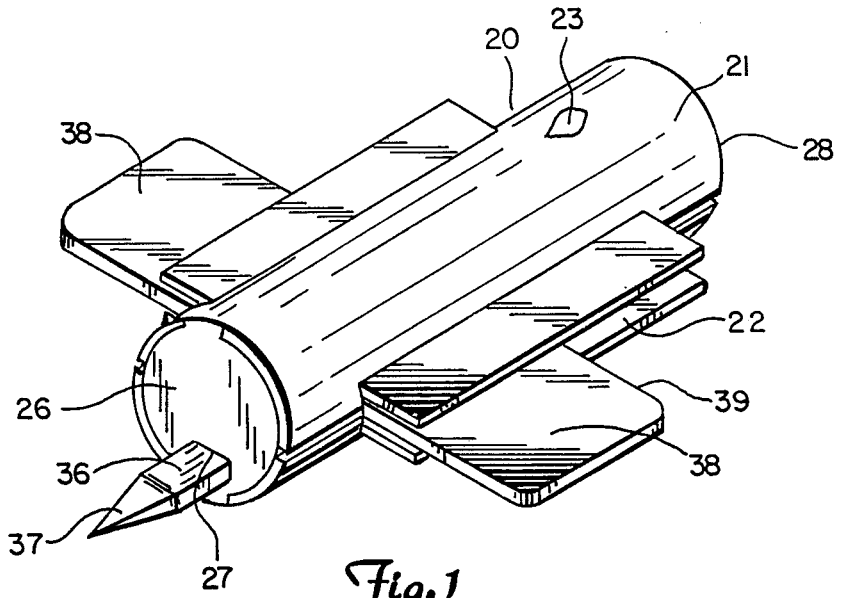
FIG. 1 is a perspective view of a window grid latch of the invention with its pin in an extended position.
Figure 5:
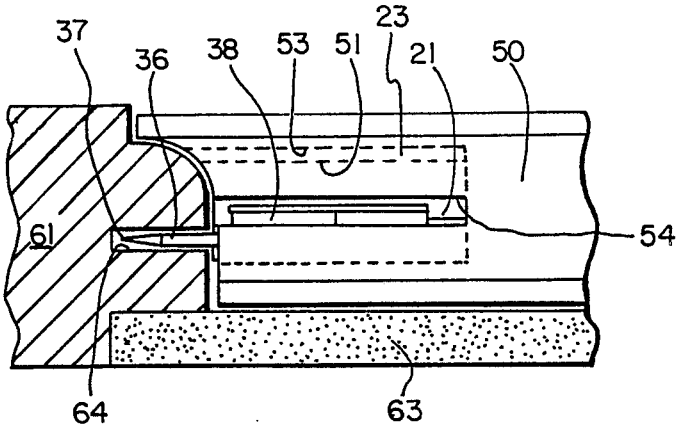
FIG. 5 is a broken away side view of the latch of FIG. 1 mounted in the end of a window grid strip with the pin being received in an opening carried by a window sash.

The window grid latch of the invention is shown in FIG. 1 as (20) and comprises a tubular housing (21), a retractable pin (36) carried by the housing (21), and a handle (38) coacting to removably attach a window grid (50) to a window sash (61) as shown in FIG. 5.

Figure 2:
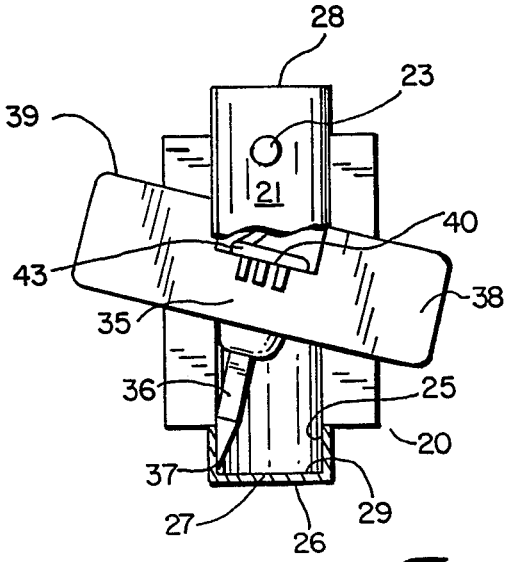
FIG. 2 is a partially broken-away view of the latch of FIG. 1 showing the pin in a retracted position.
Figure 3C:
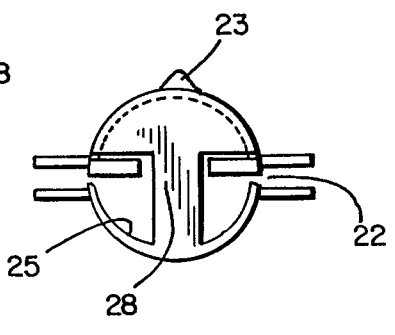
FIGS. 3, 3A, and 3B are side, forward end, and rearward end views of a portion of the latch of FIGS. 1 and 2.
Figure 3B:
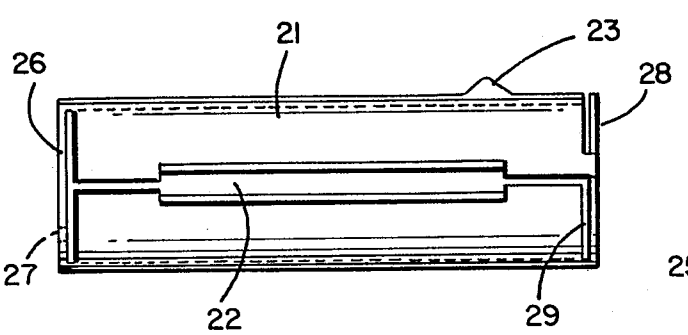
Figure 3A:
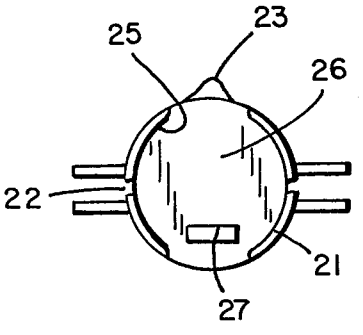
Figure 4:
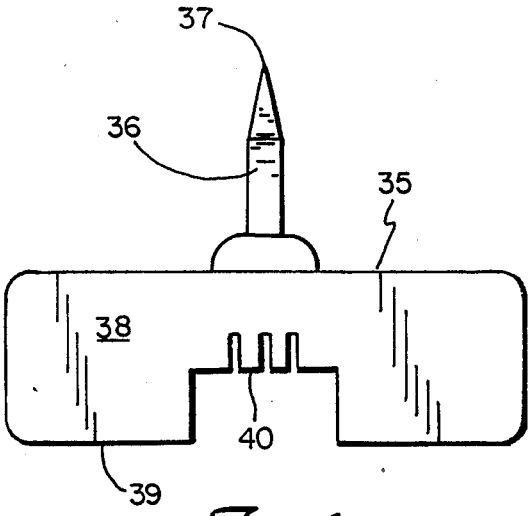
FIGS. 4 and 4A are front and right side views of the pin means utilized in the latch of FIG. 1.
Figure 4A:
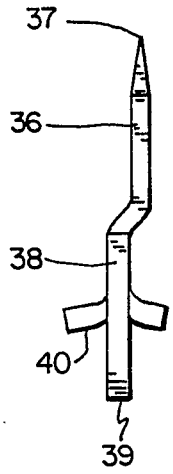

The tubular housing (21) includes a plurality of slots (22) carried by opposing walls of the housing (21), extending generally parallel to the axis of the housing (21) for slidably receiving the handle (38) extending outwardly of the housing (21). A forward opening (27) is carried by the forward end (26) of the housing (21) through which the pin (36) can extend outwardly beyond the housing (21). As shown in FIG. 3, a second end (28) of the housing (21) comprises an inner stationary surface (29) which closely contacts a pin urging means, shown in FIG. 2 as (43), which is carried within the housing (21). A generally conical protrusion (23) is carried by the housing (21) extending generally in a radially outwardly direction to contact a channel (53) in the bore (51) of a window grid strip (50) shown in FIG. 5, in general alignment with the axis of the bore (51), to prevent the housing (21) from rotating with respect to the bore (51), and to prevent the housing (21) from sliding in an axial direction with respect to the bore (51). The housing (21) is preferably stamped out of a flat piece of metal and formed into the configuration shown in FIG. 1.

Carried within the bore (25) of the housing (21) and slidable axially thereof, the pin means (35) comprises a forwardly directed pin (36), a rearwardly directed spring seat (40) which contacts the pin urging means (43), and a handle (38). These components are shown in the partially broken-away view of FIG. 2. The pin (36) protrudes axially outwardly from the forward end of the pin means (35) and extends outwardly of the housing (21) through the forward opening (27) when the device is in an extended position, as shown in FIG. 1. Preferably, the rearwardly directed spring seat (40) contacting the pin urging means (43) is recessed axially from the rearwardly directed edge (39) of the handle (38) to prevent the pin urging means (43) from moving laterally with respect to the pin means (35). Referring now to FIGS. 2 and 3, carried within and contacting the inside surface (29) of the rearwardly directed end (28) of the housing (21), is a pin urging means (43) which exerts a force on the pin means (35) axially forwardly causing the pin (36) to extend outwardly beyond the forward end (26) of the housing (21) when the device (20) is in an extended position. Preferably, the pin urging means (43) comprises a helical wire spring which is slightly compressed in an extended position, and is compressed a greater distance when the device (20) is in a retracted position.

The window grid latches (20) are preferably closely received within the axial bores (51) of the window grid strips (50), as shown in FIG. 5, with the housing (21) closely contacting the walls of the bore (51) and the protrusion (23) being closely received in an axially directed channel (53). As shown in FIG. 5, a slot (54) is carried extending through the transverse sides of the end of the window grid strip (50) to slidably receive the handle (38) of the device (20) to allow the pin (36) to be manually moved between extended and retracted positions. To move the device (20) from the extended position to the retracted position, the handle (38) is grasped and moved rearwardly thus moving the pin means (35) rearwardly within the housing (21) and retracting the pin (36) into the housing (21). When the pin (36) is retracted inside of the forward opening (27), the handle (38) is rotated slightly about an axis generally perpendicular to the longitudinal axis of the housing (21) to move the pin (36) to either side of the opening (27), enabling the pin (36) to contact the inner surface (29) of the forward end (26) of the housing (21) thus retaining the pin (36) in a retracted position as shown in FIG. 2. The device (20) is released from the retracted position by rotating the handle (38) until the pin (36) is within the periphery of the opening (27) in the forward end (26) of the housing (21) at which time the handle (38) can be released allowing the pin urging means (43) to move the device (20) into an extended position. The pin means (35) is confined to move generally in a plane which is parallel to the longitudinal axis of the housing (21).

In order to operate the grid pin latch (20) of the invention, a window grid comprised of window grid strips (50) and having window grid latches (20) in the ends of its grid strips (50), is prepared for mounting adjacent a pane of glass (63) carried by a window sash (61) by positioning the grid pin latches (20) in the retracted position. The window grid is then positioned adjacent the window pane (63) with each of the grid pin latches (20) positioned in general axial alignment adjacent corresponding grid pin-receiving means (64) carried by the window sash (61). The grid pin latches (20) are then placed in their extended position allowing the pin (36) to protrude into a grid pin-receiving means (64), or into the window sash (61) if no grid pin-receiving means is carried by the sash, thus removably retaining the window grid adjacent a window pane (63). The grid pin receiving means may comprise any type of apparatus to receive a pin therein or may simply comprise an opening in the window sash.

In another embodiment of the invention, a blunt frictional surface may be carried by the tip of the pin (36) to frictionally engage the window sash (61) when the window grid is mounted adjacent a pane of glass (63) in a window with the window grid latch (20) in an extended position. This embodiment will enable the window grid to be removably mounted to a window sash (61) which does not carry grid pin receiving means, with the pin (36) closely contacting but not penetrating the sash (61).

While a preferred embodiment of the present invention has been described, it should be understood that various changes, adaptations and modifications may be made therein without departing from the spirit of the invention and the scope of the appended claims.

What is claimed is:

1. A window grid latch comprising an elongated housing adapted to be carried by a window grid;

pin means carried by the housing and including an elongated pin movable between extended and retracted positions with respect to the housing, said pin means and housing having cooperating surfaces permitting and confining movement of the pin means to substantially a single plane with respect to the housing;

spring means carried within the housing for biasing the pin into its extended position;

the housing having a forward wall with an internal surface and with a forwardly open orifice located in said plane to receive therethrough the pin, the pin having a forward end extendable through the orifice and movable, when in its retracted position, transversely of its length in said plane within the housing between a latched position in which the forward end of the pin contacts the internal surface of the front wall of the housing and an unlatched position in which the pin is aligned with the housing orifice.

2. The window grid latch of claim 1 including exteriorly accessible handle means for moving the pin longitudinally and transversely of its length.

3. The window grid latch of claim 2 wherein the housing has slots extending through opposing walls thereof, and wherein said handle means includes handles extending outwardly through said slots.

4. The window grid latch of claim 3 wherein the housing has forward and rearward walls, the rearward wall and the pin means having spring seats between which is mounted a compression spring urging the pin into its extended position.

5. The window grid latch of claim 1 wherein the orifice of the forward wall is positioned off center with respect to said wall.

6. The window grid latch of claim 1 wherein the housing comprises a single blank of metal and wherein said pin means comprises another shaped blank of metal.

7. A window grid latch comprising an elongated housing adapted to be carried by a window grid;

pin means carried by the housing and including an elongated pin movable between extended and retracted positions with respect to the housing, said pin means and housing having cooperating surfaces confining movement of the pin means to substantially a single plane with respect to the housing;

spring means carried within the housing for biasing the pin into its extended position;

exteriorly accessible handle means for moving the pin between extended and retracted positions; the housing having a forward wall with an internal surface and with a forwardly open orifice positioned in said plane off center with respect to the wall, disposed in said plane to receive therethrough the pin, the pin having a forward end extendable through the orifice and movable transversely of its length in said plane, when in its retracted position, within the housing between a latched position in which the forward end of the pin contacts the internal surface of the front wall of the housing and an unlatched position in which the pin is aligned with the housing orifice;

the cooperating surfaces comprising confronting surfaces of longitudinal slots extending through the housing and said handle means extending outwardly through the slots.

* * * * *

UNITED STATES PATENT AND TRADEMARK OFFICE

CERTIFICATE OF CORRECTION

PATENT NO. : 4,838,001

DATED : June 13, 1989

INVENTOR(S) : Laurence Battles

It is certified that error appears in the above-identified patent and that said Letters Patent is hereby corrected as shown below:

Title page, the ABSTRACT should read as follows:

A window grid attachment device for removably attaching a decorative window grid to a window sash, adjacent a window pane. The device comprises a tubular barrel, a forward opening carried by one end of the barrel, a pin carried by the barrel which is movable axially between an extended position, in which the tip of the pin protrudes forwardly of the barrel opening, and a retracted position, in which the pin is sheltered within the barrel. A finger operable handle is included for moving the device between extended and retracted positions. A latching device is included for releasably latching the pin to the barrel in the retracted position. The window grid attachment device is carried within an axial bore of a window grid for contacting a window sash in its extended position thereby removably attaching a window grid adjacent a window pane.

Signed and Sealed this

Twenty-sixth Day of June, 1990

*Attest:*

HARRY F. MANBECK, JR.

*Attesting Officer*

*Commissioner of Patents and Trademarks*